US012055137B2

(12) United States Patent
Wang et al.

(10) Patent No.: US 12,055,137 B2
(45) Date of Patent: Aug. 6, 2024

(54) MEMS MICROPUMP TESTING METHOD AND SYSTEM

(71) Applicant: SOOCHOW UNIVERSITY, Suzhou (CN)

(72) Inventors: Yongguang Wang, Suzhou (CN); Yi Chen, Suzhou (CN); Da Bian, Suzhou (CN); Xiaoyan Zhao, Suzhou (CN); Yongxin Guo, Suzhou (CN); Yongwu Zhao, Suzhou (CN)

(73) Assignee: SOOCHOW UNIVERSITY, Suzhou (CN)

( * ) Notice: Subject to any disclaimer, the term of this patent is extended or adjusted under 35 U.S.C. 154(b) by 315 days.

(21) Appl. No.: 17/617,576

(22) PCT Filed: May 13, 2021

(86) PCT No.: PCT/CN2021/093486
§ 371 (c)(1),
(2) Date: Dec. 8, 2021

(87) PCT Pub. No.: WO2022/062424
PCT Pub. Date: Mar. 31, 2022

(65) Prior Publication Data

US 2022/0307492 A1 Sep. 29, 2022

(30) Foreign Application Priority Data

Sep. 24, 2020 (CN) ..... 202011018515.6

(51) Int. Cl.
*F04B 51/00* (2006.01)

(52) U.S. Cl.
CPC ..... *F04B 51/00* (2013.01)

(58) Field of Classification Search
CPC ..... F04B 51/00; F04B 19/006
(Continued)

(56) References Cited

U.S. PATENT DOCUMENTS 6,485,263 B1 * 11/2002 Bryant ..... F04B 43/0081 92/96
2011/0142688 A1 * 6/2011 Chappel ..... A61M 5/16854 91/1
2014/0147246 A1 * 5/2014 Chappel ..... F04D 15/0005 415/118

FOREIGN PATENT DOCUMENTS

CN 205135971 U * 4/2016
CN 205135971 U 4/2016
(Continued)

*Primary Examiner* — Marrit Eyassu
(74) *Attorney, Agent, or Firm* — SZDC Law PC

(57) ABSTRACT

The invention provides a MEMS micropump testing method and system. The method includes building a control model based on a least-square support vector; determining the magnitude of the pressure in a reservoir component relative to a preset first and second threshold in combination with a pressure value index to obtain a determination result; reading the determination result and controlling accordingly the reservoir component to be in or out of communication with the replenish component and the meter; and obtaining testing data for the under-test micropump based on variation in the liquid in the meter. The replenish component and the reservoir component assist in MEMS micropump testing so that a small volume and flow rate of the output liquid can be tested. The volumes and flow rates of the output liquid from the MEMS micropump at different pressures can be tested by controlling the pressure in the reservoir component.

6 Claims, 3 Drawing Sheets

(58) Field of Classification Search
USPC ..... 73/168
See application file for complete search history.

(56) References Cited

FOREIGN PATENT DOCUMENTS

| | | | |
|---|---|---|---|
| CN | 108303243 | A | 7/2018 |
| CN | 112160901 | A | 1/2021 |
| CN | 213180638 | U | 5/2021 |
| JP | 2003166476 | A | 6/2003 |

* cited by examiner

MEMS MICROPUMP TESTING METHOD AND SYSTEM

This application is the National Stage Application of PCT/CN2021/093486, filed on May 13, 2021, which claims priority to Chinese Patent Application No. 202011018515.6, filed on Sep. 24, 2020, which is incorporated by reference for all purposes as if fully set forth herein.

FIELD OF THE INVENTION

The present invention relates to the technical field of MEMS micropumps, and more particularly to a MEMS micropump testing method and system.

DESCRIPTION OF THE RELATED ART

In recent years, the development of MEMS technology has resulted in the development of related technologies, among which MEMS micropump is also in rapid development. However, it is very difficult to test the performance of MEMS micropumps because MEMS micropumps have a quite small size, and a very small flow rate and pressure. At present, the conventional testing method mainly involves manual testing, the outlet pressure is generally calculated through the height of the liquid column produced by the micropump. In this testing method, on the one hand, the flow rate cannot be measured by directly controlling the outlet pressure, that is, the volume and flow rate of the output liquid from the MEMS micropump at a specific pressure cannot be tested; on the other hand, manual testing has low accuracy.

SUMMARY OF THE INVENTION

This section is intended to illustrate some aspects of the embodiments of the present invention and briefly introduce some preferred embodiments. Some simplifications or omissions may be made in this section, the abstract and title of the invention to avoid obscuring the purpose of this section and the abstract and title, but such simplifications or omissions are not intended to limit the scope of the present invention.

The present invention is provided to overcome existing problems mentioned above.

Therefore, the present invention provides a MEMS micropump testing method and system, which can accurately test the volume and flow rate of the output liquid from a MEMS micropump at a specific pressure.

To solve the technical problems mentioned above, the present invention provides a MEMS micropump testing method including: building a control model based on a least-square support vector; determining the magnitude of the pressure in a reservoir component relative to a preset first threshold and second threshold in combination with a pressure value index to obtain a determination result; reading, by the control model, the determination result and controlling accordingly the reservoir component to be in or out of communication with a replenish component and a meter; and obtaining testing data for the under-test micropump based on variation in the liquid within the meter.

In a preferred embodiment of the MEMS testing method of the present invention, the determination includes: when the pressure in the reservoir component is lower than the preset first threshold, controlling, by the control model, the replenish component to be in communication with the reservoir component to replenish the reservoir component; and when the pressure in the reservoir component reaches the first threshold, controlling, by the control model, the replenish component to be out of communication with the reservoir component and controlling the under-test micropump to be communication with the reservoir component.

A preferred embodiment of the MEMS testing method of the present invention further includes: when the pressure in the reservoir component reaches the preset second threshold, controlling, by the control model, the reservoir component to be in communication with the meter; and when the pressure in the reservoir component reaches the second threshold again, controlling, by the control model, the reservoir component to be out of communication with the meter.

In a preferred solution of the MEMS testing method of the present invention, building a control model includes selecting a radial basis function as the object function for the control model according to the equation of:

$$K(x, y) = \exp\left(-\frac{\|x - y\|^2}{\sigma^2}\right)$$

where $x=\{x_1; x_2; \ldots; x_{14}\}$ is an amplitude-frequency characteristic matrix consisting of amplitude-frequency characteristic vectors of the pressure in the reservoir component, y is the amplitude-frequency characteristic vector from history data of the meter, and $\sigma$ is the kernel width, i.e., the distribution or range characteristic of the training sample number set.

In a preferred embodiment of the MEMS testing method of the present invention, the control model needs a training test, including initializing penalty parameters C and $\sigma$, training the object function by using the training samples and testing by using the testing samples; if the accuracy of the control model fails to meet the requirement, and optimizing the values assigned to the C and the $\sigma$ based on the error until the accuracy of the testing data meets the requirement, and then outputting the control model.

In a preferred embodiment of the MEMS testing method of the present invention, obtaining the testing data includes: when the pressure in the reservoir component reaches the first threshold, acquiring a first measurement scale in the meter; when the pressure in the reservoir component reaches the second threshold again, acquiring a second measurement scale in the meter; and calculating the volume of the output liquid from the under-test micropump based on the difference between the second measurement scale and the first measurement scale and the inner diameter of the meter.

A preferred embodiment of the MEMS testing system of the present invention includes a replenish component, a reservoir component, a control module and a meter. The replenish component is connected to the reservoir component and the under-test micropump, the reservoir component is connected to the under-test micropump and the meter, and the control module is connected to control ends of the replenish component, the under-test micropump and the reservoir component.

In a preferred embodiment of the MEMS testing system of the present invention, when the pressure in the reservoir component is lower than the preset first threshold, the control module controls the replenish component to be in communication with the reservoir component to replenish the reservoir component; when the pressure in the reservoir component reaches the first threshold, the control module controls the replenish component to be out of communication with the reservoir component and controls the under-test micropump to be in communication with the reservoir component; when the pressure in the reservoir component reaches the preset second threshold, the control module controls the reservoir component to be in communication with the meter; when the pressure in the reservoir component reaches the second threshold again, the control module controls the reservoir component to be out of communication with the meter; and the liquid flow performance of the under-test micropump is obtained based on the measurement results from the meter.

In a preferred embodiment of the MEMS testing system of the present invention, the replenish component includes a replenish vessel and a replenish pump, a first outlet of the replenish vessel is connected to the reservoir component via the replenish pump, a second outlet of the replenish vessel is connected to the under-test micropump, and a control end of the replenish pump is connected to the control module.

In a preferred embodiment of the MEMS testing system of the present invention, the reservoir component includes a reservoir vessel, a pressure sensor and a switching element. A first inlet of the reservoir vessel is connected to the replenish component, a second inlet of the reservoir vessel is connected to the under-test micropump, and an outlet of the reservoir vessel is connected to the meter via the switching element. The pressure sensor is provided on the reservoir vessel. The control ends of the pressure sensor and the switching element are both connected to the control module.

The present invention has the following beneficial effects: according to the present invention, the replenish component and the reservoir component are used to assist in MEMS micropump testing so that a small volume and flow rate of the output liquid can be tested. Meanwhile, the volumes and flow rates of the output liquid from the MEMS micropump at different pressures can be tested by controlling the pressure in the reservoir component. Additionally, a check valve is used in this system so that no backflow of liquid occurs during testing, thereby ensuring the accuracy of testing.

BRIEF DESCRIPTION OF THE DRAWINGS

In order to explain the technical solution of the embodiments of the present invention more clearly, the drawings used in the description of the embodiments will be briefly introduced below. Obviously, the drawings in the following description merely depict some embodiments of the present invention, and those of ordinary skill in the art can obtain other drawings based on these drawings without creative efforts.

DETAILED DESCRIPTION OF THE PREFERRED EMBODIMENTS

Figure 1:
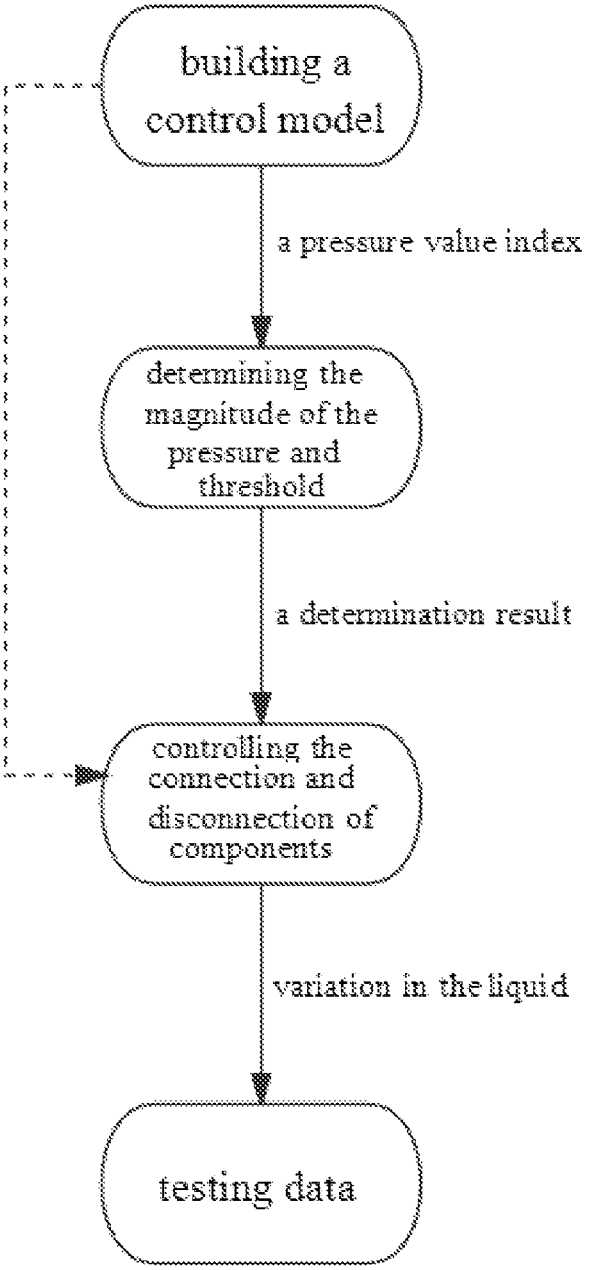
FIG. 1 is a schematic flowchart of a MEMS micropump testing method according to a first embodiment of the present invention.

In order to make the above objects, features and advantages of the present invention more obvious and understandable, particular embodiments of the present invention will be described in detail with reference to the drawings. Obviously, the described embodiments are only some embodiments of the present invention, but not all of them. Based on the embodiments of the present invention, all other embodiments obtained by those of ordinary skill in the art without creative efforts shall fall within the protection scope of the present invention.

In the following description, many specific details are set forth to aid in full understanding of the present invention, but the present invention can be implemented in other ways different from those described herein, and those skilled in the art can make similar popularization without violating the conception of the present invention, so the present invention is not limited by the particular embodiments disclosed below.

Secondly, "one embodiment" or "an embodiment" as used herein refers to a specific feature, structure or characteristic that can be included in at least one implementation of the present invention. The expression "in an embodiment" as used throughout this specification do not all refer to the same embodiment, nor are they separate or selective embodiments mutually exclusive from other embodiments.

The present invention will be described in detail with the schematic views. When describing the embodiments of the present invention in detail, for convenience of explanation, the cross-sectional view showing the device structure shall not be enlarged locally in general scale, and the schematic view is merely an example, which should not limit the scope of protection of the present invention herein. In addition, the three-dimensional dimensions of length, width and depth should be included in the actual production.

Meanwhile, in the description of the present invention, it should be noted that the orientations or positional relationships indicated by the terms "upper, lower, inner and outer" are based on the orientations or positional relationships shown in the drawings and are only intended for the convenience of describing the present invention and simplifying the description, but do not indicate or imply that the referred devices or elements must have a specific orientation, be constructed and operated in a specific orientation, so they cannot be understood as limiting the present invention. In addition, the terms "first, second or third" are only used for the purpose of description, and shall not be understood as indicating or implying any relative importance.

Unless otherwise specified and defined in the present invention, the terms "mounted, coupled or connected" should be understood in a broad sense, for example, it may be fixed connection, detachable connection or integrated connection. It may also be mechanical connection, electrical connection or direct connection, or indirect connection through an intermediate medium, or internal communication between two elements. For those of ordinary skills in the art, the specific meanings of the above terms in the present invention can be understood in conjunction with specific contexts.

Embodiment 1

Figure 2:
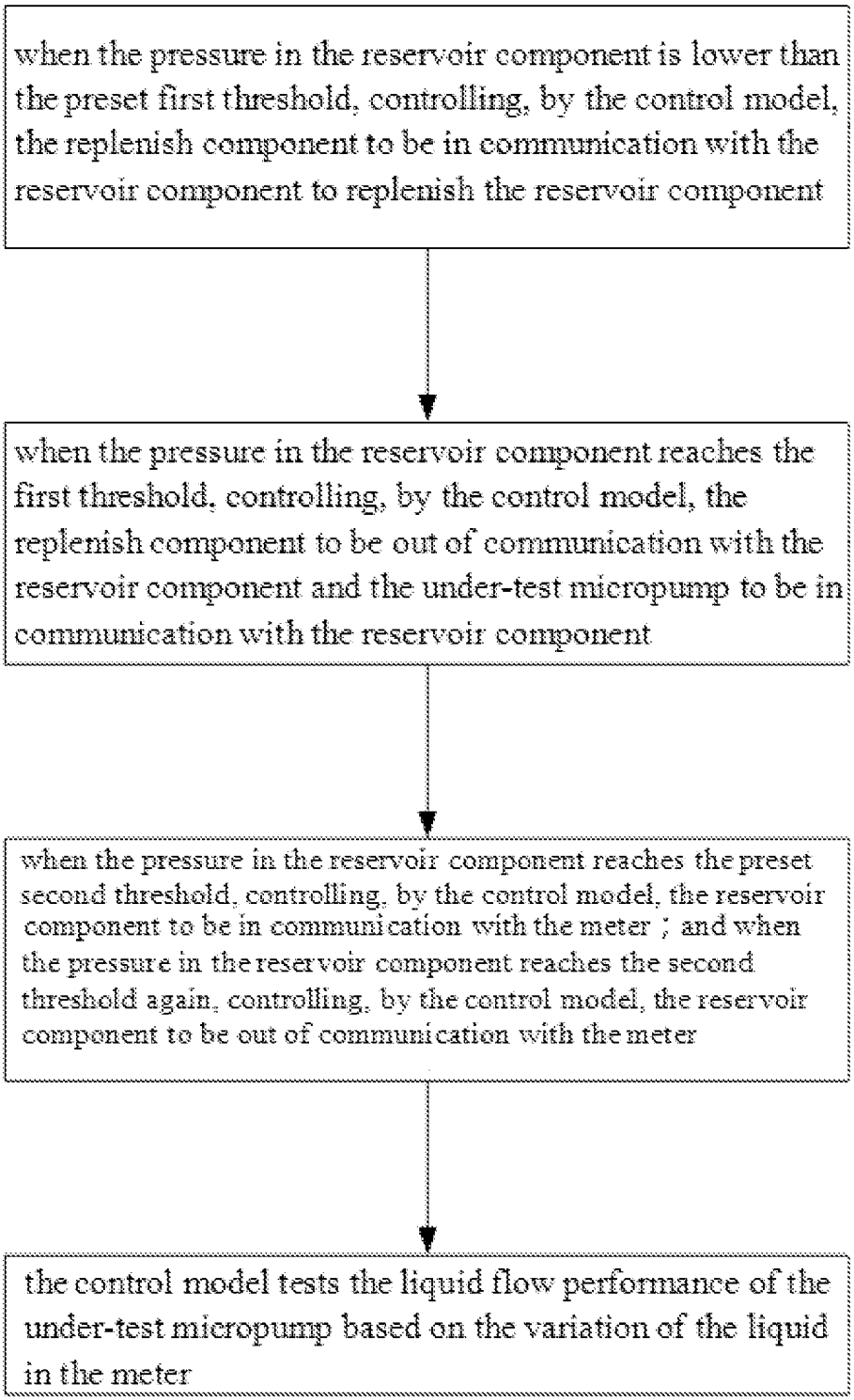
FIG. 2 is a schematic flowchart of determination and control in the MEMS micropump testing method according to the first embodiment of the present invention.

Referring to FIGS. 1 and 2, a MEMS micropump testing method is provided according to a first embodiment of the present invention, including the following steps.

S1: building a control model based on a least-square support vector; wherein it is noted that building a control model includes selecting a radial basis function as the object function for the control model according to the equation of:

$$K(x, y) = \exp\left(-\frac{\|x-y\|^2}{\sigma^2}\right)$$

where $x=\{x_1; x_2; \ldots; x_{14}\}$ is an amplitude-frequency characteristic matrix consisting of amplitude-frequency characteristic vectors of the pressure in the reservoir component, y is the amplitude-frequency characteristic vector from history data of the meter, and $\sigma$ is the kernel width, i.e., the distribution or range characteristic of the training sample number set.

Preferably, the control model needs a training test, including initializing penalty parameters C and $\sigma$, training the object function by use of the training samples and testing by use of the testing samples; and if the accuracy of the control model does not meet the requirement, optimizing the values assigned to C and $\sigma$ based on the error until the accuracy of the testing data meets the requirement and then outputting the control model.

S2: determining the magnitude of the pressure in a reservoir component relative to a preset first threshold and second threshold in combination with a pressure value index to obtain a determination result.

S3: reading, by the control model, the determination result and controlling accordingly the reservoir component to be in or out of communication with the replenish component and the meter;

wherein in this step, it is noted that: when the pressure in the reservoir component is lower than the preset first threshold, the control model controls the replenish component to be in communication with the reservoir component to replenish the reservoir component;

when the pressure in the reservoir component reaches the first threshold, the control model controls the replenish component to be out of communication with the reservoir component and controls the under-test micropump to be communication with the reservoir component;

when the pressure in the reservoir component reaches the preset second threshold, the control model controls the reservoir component to be in communication with the meter; and when the pressure in the reservoir component reaches the second threshold again, the control model controls the reservoir component to be out of communication with the meter.

S4: obtaining testing data for the under-test micropump based on variation in the liquid within the meter;

wherein it is further noted that obtaining the testing data includes, when the pressure in the reservoir component reaches the first threshold, acquiring a first measurement scale in the meter; when the pressure in the reservoir component reaches the second threshold again, acquiring a second measurement scale in the meter; and calculating the volume of the output liquid from the under-test micropump based on the difference between the second measurement scale and the first measurement scale and the inner diameter of the meter.

Preferably, in this embodiment it is further noted that, when the pressure in the reservoir component is lower than the preset first threshold, the control model controls the replenish component to be in communication with the reservoir component to replenish the reservoir component. That is, the replenish pump is in communication with the reservoir vessel via a first check valve, and the replenish pump transports the liquid in the replenish vessel to the reservoir vessel. When the pressure in the reservoir component reaches the first threshold, the control model controls the replenish component to be out of communication with the reservoir component and controls the under-test micropump to be in communication with the reservoir component. That is, the replenish pump is out of communication with the reservoir vessel and liquid output is ceased, the under-test micropump is in communication with the reservoir vessel via a second check valve, and the under-test micropump transports the liquid in the replenish vessel to the reservoir vessel. When the pressure in the reservoir component reaches the preset second threshold, the control model controls the reservoir component to be in communication with the meter. That is, the control model controls the switching element to be switched on, so that the reservoir vessel is in communication with the meter via the switching element and the reservoir vessel outputs liquid to the meter. When the pressure in the reservoir component reaches the second threshold again, the control model controls the reservoir component to be out of communication with the meter. That is, the control model controls the switching element to be switched off, so that the reservoir vessel is out of communication with the meter and liquid output is ceased.

Preferably, the control model in this embodiment can test the liquid flow performance of the micropump based on the variation of the liquid in the meter. That is, the volume of the output liquid from the under-test micropump can be calculated based on the measurement scale and the inner diameter of the meter. When the pressure in the reservoir component reaches the first threshold, i.e., when the pressure in the reservoir vessel reaches the first threshold, the first measurement scale in the meter is acquired, when the pressure in the reservoir component reaches the second threshold again, i.e., when the pressure in the reservoir vessel reaches the second threshold, the second measurement scale in the meter is acquired; and the volume of the output liquid from the under-test micropump is calculated based on the difference between the second measurement scale and the first measurement scale and the inner diameter of the meter.

Generally speaking, in this embodiment, a second threshold is set to allow testing of the volume of the output liquid from the under-test micropump at a second threshold pressure, thereby allowing testing of the volume of the output liquid from the under-test micropump at a specific pressure. Meanwhile, a first threshold is set to control the replenish component to output a particular volume of liquid to the reservoir component, so that the transport time of liquid from the under-test micropump to the reservoir component is reduced and consequently the efficiency of testing is improved.

In order to verify and demonstrate the technical effect adopted in the method of the present invention, in this embodiment, the conventional manual MEMS testing method is selected for a comparative test with respect to the method of the present invention, and the testing results are compared by means of scientific demonstration to verify the real effect of the method of the present invention.

The conventional manual MEMS testing method has low testing efficiency and accuracy and is not widely applicable. In order to verify that the method of the present invention has higher accuracy and efficiency and wider applicability compared with the conventional method, the conventional manual MEMS testing method and the method of the present invention are respectively used in this embodiment for real-time measurement for a MEMS micropump.

Testing environment: The under-test micropump runs on a simulation platform for a simulation run, and the volume and flow rate of the output liquid at a specific pressure is simulated. 100 groups of real output data acquired in the field are used as the testing samples. Manual testing is performed manually by using the conventional method and the testing result data is recorded. With the method of the present invention, an automatic testing device is started to conduct simulation testing in the method of the present invention through MATLB. Simulation data is obtained based on the experimental results. Testing is performed on ten groups of data using the two methods respectively to calculate the time and test value for each group of data, which are then compared with the real output test values resulting from simulation input for error calculation. The results are shown in the table below.

TABLE 1 efficiency and error comparison data table.

| | Conventional method | | Method of the present invention | |
|---|---|---|---|---|
| Test group | time/min | error/% | time/min | error/% |
| First group | 48 | 43.659 | 18 | 15.326 |
| Second group | 50 | 41.251 | 22 | 14.952 |
| Third group | 46 | 45.218 | 19 | 15.001 |
| Fourth group | 42 | 44.329 | 16 | 14.986 |
| Fifth group | 53 | 39.987 | 20 | 14.036 |
| Sixth group | 69 | 40.841 | 18 | 13.521 |
| Seventh group | 60 | 45.226 | 20 | 15.087 |
| Eighth group | 55 | 42.351 | 22 | 15.452 |
| Ninth group | 49 | 43.845 | 19 | 14.352 |
| Tenth group | 42 | 44.652 | 17 | 14.875 |

It is further noted that three tests are conducted in this embodiment using the method of the present invention for 5 hours to obtain three results from simulation: 2.72 ml, 2.71 ml and 2.68 ml. As can be intuitively seen from Table 1, with the conventional manual method in which the outlet pressure is calculated through the height of the liquid column output from the micropump, the volume and flow rate of the output liquid from the MEMS micropump at a specific pressure cannot be tested, resulting in both low efficiency operation and increased amount of error. However, the method of the present invention has significantly higher efficiency as well as higher testing accuracy than the conventional manual method. Based on this, the real effects of the method of the present invention are verified.

Embodiment 2

Figure 3:
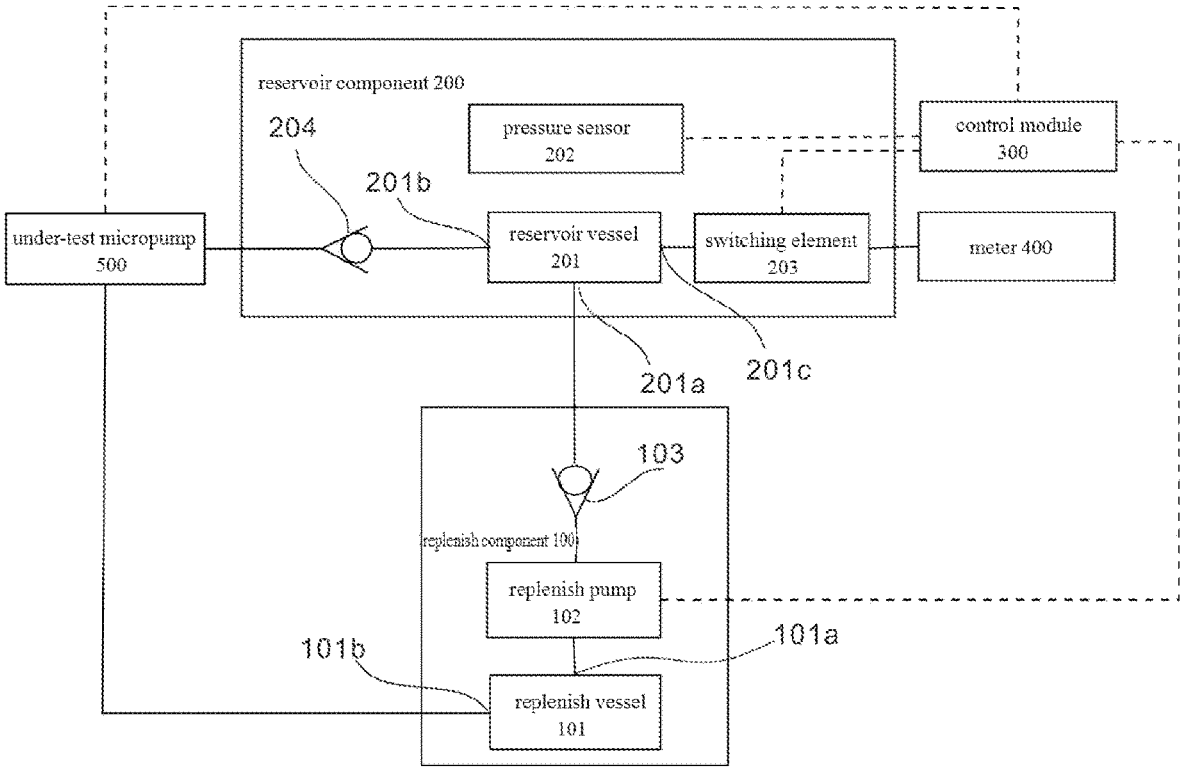
FIG. 3 is a schematic diagram of the structural distribution of a MEMS micropump testing system according to a second embodiment of the present invention.

Referring to FIG. 3, an embodiment a second embodiment of the present invention provides a MEMS micropump testing system that includes a replenish component 100, a reservoir component 200, a control module 300 and a meter 400.

Specifically, the replenish component 100 includes a replenish vessel 101, a replenish pump 102 and a first check valve 103. The replenish pump 102 is connected to the reservoir component 200 via the first check valve 103. The first outlet 101*a* of the replenish vessel 101 is connected to the reservoir component 200 via the replenish pump 102. The second outlet 101*b* of the replenish vessel 101 is connected to the under-test micropump 500. The control end of the replenish pump 102 is connected to the control module 300.

Preferably, the reservoir component 200 includes a reservoir vessel 201, a pressure sensor 202 and a switching element 203. The first inlet 201*a* of the reservoir vessel 201 is connected to the replenish component 100. The second inlet 201*b* of the reservoir vessel 201 is connected to the under-test micropump 500. The outlet 201*c* of the reservoir vessel 201 is connected to the meter 400 via the switching element 203. The pressure sensor 202 is provided on the reservoir vessel 201. The control ends of the pressure sensor 202 and the switching element 203 are both connected to the control module 300.

Preferably, the control module 300 (a setting control model) is configured to calculate the volume of the output liquid from the under-test micropump 500 based on the measurement scale and the inner diameter of the meter 400. For example, when the pressure in the reservoir component 200 reaches the first threshold (i.e., when the pressure in the reservoir vessel 201 reaches the first threshold), the first measurement scale in the meter 400 is acquired. Although the switching element 203 has not been turned on at this point, some leakage may still occur in the system. Therefore, some liquid may exist in the meter 400. Thus, the volume of this liquid is used as the initial measurement scale (i.e., the first measurement scale); and when the pressure in the reservoir component 200 reaches the second threshold again (i.e., when the pressure in the reservoir vessel 201 reaches the second threshold again), a second measurement scale in the meter 400 is acquired. Then the volume of the output liquid from the under-test micropump 500 is calculated based on the difference between the second measurement scale and the first measurement scale, and the inner diameter of the meter 400. By measuring the first measurement scale and subtracting it from the final testing result (i.e., the second measurement scale), the error due to leakage can be eliminated, thereby improving the testing accuracy.

Preferably, the meter 400 is provided with a measurement scale. For example, it may be a discharge pipe with a measurement scale. The scale on the discharge pipe is readout. Then the volume of the output liquid can be obtained based on this scale in association with the inner diameter of the feeding pipe.

Preferably, the replenish component 100 is connected to the reservoir component 200 and the under-test micropump 500. The reservoir component 200 is connected respectively to the under-test micropump 500 and the meter 400. The control module 300 is connected to the control ends of the replenish component 100, the under-test micropump 500 and the reservoir component 200. It is further noted in this embodiment that:

When the pressure in the reservoir component 200 is lower than a preset first threshold, the control module 300 controls the replenish component 100 to be in communication with the reservoir component 200 to replenish the reservoir component 200.

When the pressure in the reservoir component 200 reaches the first threshold, the control module 300 controls the replenish component 100 to be out of communication with the reservoir component 200 and controls the under-test micropump 500 to be in communication with the reservoir component 200.

When the pressure in the reservoir component 200 reaches a preset second threshold, the control module 300 controls the reservoir component 200 to be in communication with the meter 400.

When the pressure in the reservoir component 200 reaches the second threshold again, the control module 300 controls the reservoir component 200 to be out of communication with the meter 400.

The performance of liquid flow from the under-test micropump 500 is obtained based on the measurement results of the meter 400.

The present testing system further includes a timer configured to record the testing duration (i.e., the time from the start of the under-test micropump and its communication with the reservoir component to the disconnection between the reservoir component and the meter and the end of the testing). The flow rate of output liquid from the under-test micropump is obtained based on this testing duration and the volume of output liquid from the under-test micropump already obtained from testing.

This embodiment further provides a micropump liquid flow testing device in which the replenishing function of a replenish component is implemented specifically by a replenish pump and a replenish vessel, and the function of a reservoir component of setting a specific pressure for the testing system is implemented specifically by a reservoir vessel, a pressure sensor and a switching element. By selecting different replenish pumps, reservoir vessels and the like, various pressures can be set flexibly, while the testing efficiency of the system can be controlled flexibly. Meanwhile, two check valves are used to prevent liquid backflow in the testing system, thereby increasing the testing accuracy. Besides, the volume of output liquid from the under-test micropump is obtained through a meter with measurement scales, and the output flow of the under-test micropump is further obtained based on this volume in association with the testing duration.

It should be understood that embodiments of the present invention can be achieved or implemented by computer hardware, a combination of hardware and software, or by computer instructions stored in a non-transitory computer-readable memory. The method can be implemented in a computer program using standard programming techniques, including a non-transitory computer readable storage medium configured with a computer program. The storage medium causes the computer to operate in a specific and predefined manner, according to the method described in the particular embodiments and the drawings. Each program can be implemented in a high-level process or object-oriented programming language to communicate with a computer system. However, if necessary, the program can be implemented in assembly or machine language. In any case, the language can be a compiled or interpreted language. In addition, the program can be run on a programmed ASIC for this purpose.

Furthermore, the operations of the processes described herein may be performed in any suitable order, unless otherwise indicated herein or otherwise clearly contradicted by context. The processes (or variations and/or combinations thereof) described herein may be executed under the control of one or more computer systems configured with executable instructions, and may be implemented as codes (e.g., executable instructions, one or more computer programs, or one or more applications), hardware, or combinations thereof that are jointly executed on one or more processors. The computer program includes a plurality of instructions executable by one or more processors.

Further, the method can be implemented in any suitable type of computing platform that is operatively connected, including but not limited to personal computers, mini computers, main frames, workstations, network or distributed computing environments, separate or integrated computer platforms, or those in communication with charged particle tools or other imaging devices, etc. Aspects of the present invention can be implemented in machine readable codes stored on non-transitory storage media or devices, whether removable or integrated into a computing platform, such as a hard disk, optical read and/or write storage media, RAM, ROM, etc., so that it can be read by a programmable computer, and when the storage media or devices are read by a computer, it can be used to configure and operate the computer to perform the processes described herein. In addition, the machine-readable codes, or parts thereof, may be transmitted through a wired or wireless network. While such media include instructions or programs that implement the steps described above in conjunction with a microprocessor or other data processor, the invention described herein includes these and other different types of non-transitory computer-readable storage media. When programmed according to the methods and techniques of the present invention, the present invention also includes the computer itself. A computer program can be applied to input data to perform the functions described herein, thereby converting the input data to generate output data that is stored in nonvolatile memory. Output information may also be applied to one or more output devices such as a display. In a preferred embodiment of the present invention, the converted data represents physical and tangible objects, including specific visual depictions of the physical and tangible objects generated on the display.

As used in this application, the terms "component", "module", "system" and the like are intended to refer to a computer-related entity, which may be hardware, firmware, a combination of hardware and software, software or running software. For example, a component can be, but is not limited to, a process running on a processor, a processor, an object, an executable file, an executing thread, a program, and/or a computer. By way of example, both an application running on a computing device and the computing device can be components. One or more components may exist in an executing process and/or thread, and the components may be located in one computer and/or distributed between two or more computers. In addition, these components can be executed from various computer-readable media having various data structures thereon. These components can communicate in the manner of local and/or remote procedure through signals (such as) with one or more data packets (for example, data from a component that interacts with another component in a local system or a distributed system, and/or interacts with other systems through a network such as the Internet via signals).

It should be noted that the above embodiments are only intended to illustrate the technical solutions of the present invention instead of limitation. Although the present invention has been described in detail with reference to the preferred embodiments, those of ordinary skill in the art should understand that the technical solutions of the present invention can be modified or equivalently replaced without departing from the spirit and scope of the technical solutions of the present invention, which should be covered in the claims of the present invention.

What is claimed is:

1. A MEMS micropump testing method, comprising:

building a control model based on a least-square support vector;

determining a magnitude of a pressure in a reservoir component relative to a preset first threshold and a preset second threshold in combination with a pressure value index to obtain a determination result;

reading, by the control model, the determination result and controlling accordingly the reservoir component to be in or out of communication with a replenish component and a meter; and obtaining testing data for an under-test micropump based on variation in the liquid within the meter, wherein the determination comprises:

determining that when the pressure in the reservoir component is lower than the preset first threshold, controlling, by the control model, the replenish component to be in communication with the reservoir component to replenish the reservoir component;

determining that when the pressure in the reservoir component reaches the preset first threshold, controlling, by the control model, the replenish component to be out of communication with the reservoir component and the under-test micropump to be in communication with the reservoir component;

determining that when the pressure in the reservoir component reaches the preset second threshold, controlling, by the control model, the reservoir component to be in communication with the meter; and determining that when the pressure in the reservoir component reaches the preset second threshold again, controlling, by the control model, the reservoir component to be out of communication with the meter;

wherein the MEMS micropump testing method further comprises controlling a MEMS micropump testing system in operation, and the MEMS micropump testing system comprises a replenish component (100), a reservoir component (200), a control module (300) and a meter (400);

wherein the replenish component (100) is connected to the reservoir component (200) and the under-test micropump (500), the reservoir component (200) is connected to the under-test micropump (500) and the meter (400), and the control module (300) is connected to the control ends of the replenish component (100), the under-test micropump (500) and the reservoir component (200);

determining that when the pressure in the reservoir component (200) is lower than the preset first threshold, the replenish component (100) is controlled by the control module (300) to be in communication with the reservoir component (200) to replenish the reservoir component (200);

determining that when the pressure in the reservoir component (200) reaches the preset first threshold, the replenish component (100) is controlled by the control module (300) to be out of communication with the reservoir component (200) and the under-test micropump (500) is controlled by the control module (300) to be in communication with the reservoir component (200);

determining that when the pressure in the reservoir component (200) reaches the preset second threshold, the reservoir component (200) is controlled by the control module (300) to be in communication with the meter (400);

determining that when the pressure in the reservoir component (200) reaches the preset second threshold again, the reservoir component (200) is controlled by the control module (300) to be out of communication with the meter (400); and obtaining the flow performance of the liquid from the under-test micropump (500) based on measurement results of the meter (400).

2. The MEMS micropump testing method of claim 1, wherein the building the control model includes selecting a radial basis function as an object function for the control model according to the equation of:

$$K(x, y) = \exp\left(-\frac{\|x - y\|^2}{\sigma^2}\right)$$

where $x=\{x_1; x_2; \ldots; x_{14}\}$ is an amplitude-frequency characteristic matrix consisting of amplitude-frequency characteristic vectors of the pressure in the reservoir component, y is the amplitude-frequency characteristic vector from history data of the meter, and $\sigma$ is the kernel width, i.e., a distribution or range characteristic of a training sample number set.

3. The MEMS micropump testing method of claim 2, wherein the control model needs a training test, comprising:

initializing penalty parameters C and $\sigma$, training the object function by using training samples and testing by using testing samples; and determining that when an accuracy of the control model does not meet a requirement, optimizing values assigned to the C and the $\sigma$ based on an error until the accuracy of the testing data meets the requirement and then outputting the control model.

4. The MEMS micropump testing method of claim 2, wherein obtaining the testing data comprises:

determining that when the pressure in the reservoir component (200) reaches the preset first threshold, acquiring a first measurement scale in the meter (400);

determining that when the pressure in the reservoir component (200) reaches the preset second threshold again, acquiring a second measurement scale in the meter (400); and calculating a volume of an output liquid from the under-test micropump (500) based on a difference between the second measurement scale and the first measurement scale and an inner diameter of the meter (400).

5. The MEMS micropump testing method of claim 4, wherein the replenish component (100) comprises a replenish vessel (101) and a replenish pump (102); and a first outlet of the replenish vessel (101) is connected to the reservoir component (200) via the replenish pump (102), a second outlet of the replenish vessel (101) is connected to the under-test micropump (500), and a control end of the replenish pump (102) is connected to the control module (300).

6. The MEMS micropump testing method of claim 5, wherein the reservoir component (200) comprises a reservoir vessel (201), a pressure sensor (202) and a switching element (203);

wherein a first inlet of the reservoir vessel (201) is connected to the replenish component (100), a second inlet of the reservoir vessel (201) is connected to the under-test micropump (500), an outlet of the reservoir vessel (201) is connected to the meter (400) via the switching element (203), the pressure sensor (202) is provided on the reservoir vessel (201), and control ends of the pressure sensor (202) and the switching element (203) are both connected to the control module (300).

* * * * *